United States Patent [19]

Nielsen

[11] 4,301,963

[45] Nov. 24, 1981

[54] INTEGRAL ONE PIECE CENTRIFUGE TUBE

[75] Inventor: Steven T. Nielsen, Sunnyvale, Calif.

[73] Assignee: Beckman Instruments, Inc., Fullerton, Calif.

[21] Appl. No.: 121,755

[22] Filed: Feb. 15, 1980

Related U.S. Application Data

[63] Continuation of Ser. No. 912,698, Jun. 5, 1978, abandoned.

[51] Int. Cl.[3] ..... B04B 7/00; B04B 15/00

[52] U.S. Cl. ..... 233/26; 233/1 A; 422/102; 150/1; 215/1 C

[58] Field of Search ..... 233/1 R, 1 A, 20 R, 233/27, 46, 47, 26; 422/72, 102, 58, 105; 210/DIG. 23, DIG. 24, 516; 128/2 F; 215/1 C, 232; 150/1

[56] References Cited

U.S. PATENT DOCUMENTS

| | | | |
|---|---|---|---|
| 2,699,289 | 1/1955 | Allen | 233/26 |
| 3,185,154 | 5/1965 | Caccavo | 233/26 X |
| 3,545,671 | 12/1970 | Ross | 233/26 |
| 3,708,110 | 1/1973 | Unger | 233/26 |
| 3,998,383 | 12/1976 | Romanauskas | 233/26 |
| 4,015,775 | 4/1977 | Rohde | 233/26 |

FOREIGN PATENT DOCUMENTS

| | | |
|---|---|---|
| 600480 | 4/1948 | United Kingdom . |
| 616379 | 1/1949 | United Kingdom . |
| 658216 | 10/1951 | United Kingdom . |
| 861466 | 2/1961 | United Kingdom . |
| 1122787 | 8/1968 | United Kingdom . |
| 1331140 | 9/1973 | United Kingdom . |

*Primary Examiner*—Robert W. Jenkins

*Attorney, Agent, or Firm*—R. J. Steinmeyer; F. L. Mehlhoff; William H. May

[57] ABSTRACT

A substantially enclosed centrifuge tube having a small fill or access port at one end. In its preferred form there is integrally formed adjacent the fill port a neck or stem which is fused to hermetically seal the centrifuge tube to provide a permanent and complete seal of the centrifuge tube. A plug is securely mounted within the centrifuge rotor above the centrifuge tube when placed in the rotor to provide solid support adjacent the complete exterior surface of the tube. The interior of the plug is shaped to conform and mate with the upper end of the centrifuge tube. The use of a removable capping means placed on the centrifuge tube is eliminated. Access to the tube subsequent to the centrifugation run requires puncturing or cutting of the tube.

15 Claims, 13 Drawing Figures

INTEGRAL ONE PIECE CENTRIFUGE TUBE

This is a continuation of application Ser. No. 912,698, filed June 5, 1978, now abandoned.

BACKGROUND OF THE INVENTION

The present invention is directed to centrifuge tubes and, more particularly, is directed to a permanently enclosed or sealed centrifuge tube requiring no capping means.

Typical centrifuge rotor tubes have a generally uniform cylindrical shape with one end being completely open to receive the fluid sample for subjection to centrifugation. After the introduction of the fluid sample within the tube, some type of capping means is required on the open end of the tubes when used in rotors wherein the tube is placed in a fixed position oriented at an acute angle or even zero degrees to the spin axis of the rotor. The removable capping means is necessary to prevent leakage of the fluid sample from the tube that could otherwise be caused by the large hydrostatic forces generated during high speed centrifugation.

A continual problem with the placement of capping means on the open ended centrifuge tubes is ensuring that a proper seal has been achieved between the cap and the tube to prevent any possible or potential leakage which could occur. Although swinging bucket type of rotors do not require capping means to establish a seal over the top of the centrifuge tubes because the centrifugal forces are directed toward the bottom of the bucket, sealing concerns increase as the angle orientation of the tube with respect to the spin axis is less than 90°. The most significant concern for sealing the centrifuge tube occurs when the angle of the tube with respect to the spin axis is zero or essentially vertical. Various configurations have been devised for capping centrifuge tubes to eliminate any potential leakage which may occur. Present capping means are typically very complicated in their manufacture and construction as well as in their use and application for attachment to the tube.

The significance of eliminating or preventing any potential leakage in a high speed centrifuge cannot be underestimated, because the fluid sample may contain some type of bacteria or some valuable type of material which the user does not wish to lose through leakage during the centrifugation run. Further, any leakage which may occur during the centrifugation run will invalidate the run resulting in great inefficiency in the use of the centrifuge. Since many of the fluid samples which are investigated during the centrifuge run contain important ingredients for use by a scientist or technician, the leakage of a centrifuge tube during a run can create significant problems as well as the waste of an operator's time.

In many instances, the resulting leak is caused by an improper seal being achieved between the capping means and the centrifuge tube because of either a poor configuration or design of the capping means or as a result of the improper placement of the capping means on the tube. Not only is it important that the capping means be designed to achieve a secure seal between the test tube and the capping means prior to the centrifugation run, but also it is important that the capping means have such a design that it is easy to remove after the centrifugation run without having to disturb the contents of the fluid sample after the centrifugation. Otherwise, the sample constituents may be remixed and invalidate the centrifugation run.

Typically the capping means is utilized on a disposable type of centrifuge tube which is somewhat flexible. Many of the capping means used are designed to tightly grip the open end of the centrifuge tube which is flexible or pliable and conform the open end of the tube to the gripping portion of the capping means. However, the open end of the tube must be inserted properly and completely within the capping means in order to achieve a secure seal when the capping means is tightened. Unfortunately, the tube often is not completely inserted within the capping means, so that, when the cap is tightened, a proper seal is not achieved.

Present capping means utilized to achieve a proper seal not only are somewhat complicated in design and construction, resulting in a somewhat difficult and less than perfect manner in which to seal the centrifuge tube, but also are an expensive part of the centrifuge rotor and tube assembly.

A significant problem faced by users of centrifuge apparatus having tubes with present capping means is the possible contamination of the fluid sample within the tube by its contact with the material utilized to construct the capping means. In other words, the metal and plastic pieces typically utilized to construct the capping means may cause some type of contamination or reaction with the fluid sample that would invalidate the test being conducted on that particular sample.

In addition to the concern with respect to the material in the capping assembly structure contaminating the fluid sample within the tube, there is a continual concern with respect to corrosion of the cap components or members from the fluid sample in the tube after repeated use, resulting in an unusable cap or one which does not seal properly.

As stated previously, the typical centrifuge tube utilized in many rotors is made of a very pliable or flexible material, andd it is necessary that the tube be completely filled with the fluid sample in order to provide the necessary interior support to the tube during centrifugation, so that the centrifugal side of the tube does not collapse and cause the pulling of the tube out of the capping means.

SUMMARY OF THE INVENTION

The present invention comprises a centrifuge tube having a central portion with an integrally formed enclosed bottom portion and an integrally formed substantially enclosed top portion having a fill port. The fill port is substantially smaller in size than the diameter or width of the tube. Integrally formed about the fill port is a protruding or projecting neck through which the fluid sample is inserted into the tube. Once the tube is completely filled with the sample, heat is applied to the neck portion to create a heat seal and hermetically seal the fluid sample permanently within the tube. The fluid contents, therefore, are sealed within the centrifuge tube and no removable capping means or similar means are incorporated into the design of the tube. The only manner in which the fluid sample can be extracted from the tube after centrifugation is by either puncturing the tube or cutting the tube adjacent to the projecting neck.

Since the fluid sample is permanently sealed within the centrifuge tube, there is no potential of leakage of the fluid sample. The elimination of any type of capping means attached to the centrifuge tube prevents the potential leakage which could occur at this interface between the tube and the capping means. Further, there is no contact of the fluid sample with any material other than the material from which the tube is made. Therefore, the sample does not receive any contaminating contact with materials of a capping assembly as found in typical prior centrifuge tubes.

The elimination of a capping assembly not only reduces the cost in using a centrifuge rotor, but also eliminates the generally unsatisfactory manner of placement and removal of the capping means from the tube which presented a potential source of leakage.

When the enclosed tube is placed within the rotor a cap or plug conforming to both the rotor and the upper portion of the tube is necessary to retain the tube within the rotor during centrifugation. The plug provides the rigid or solid support to the upper portion of the tube, so that it is solidly supported throughout its entire interior surface.

The location of the fill port can be at any point in the tube, but is preferably found in the top portion of the tube. It can be located in the center of the tube or at any point between the center and the outer cylindrical wall of the tube. If the fill ports are located adjacent the centripetal side of the tube, less hydrostatic force will be exerted against the fill port area greatly reducing the force which the heat seal on the tube must withstand. In addition, it may be possible to eliminate the requirement for a heat seal by making the tube with a neck portion sufficiently long that the opening in the neck portion will be bent to curve to a position inward from the tube or closer to the spin axis than the tube. Therefore, the tube could be run without being sealed.

Although the primary configuration of the centrifuge tube is generally cylindrical, the container or tube may be sector shaped, rectangular shaped or cylindrical with flat top and bottom configurations. The exact shape of the tube or container can be varied according to the desires of the rotor configuration. One of the primary features of the present invention is a hermetically sealed centrifuge tube without a removable capping assembly. Another important feature of the present invention is the fact that the material used to heat seal the tube is integrally formed on the tube. In the alternative, additional heat fused material can be used to plug in the tube. A further important feature is the use of the tube in combination with a conforming plug to provide support to the upper portion of the tube.

The present centrifuge tube is preferably made by blow molding which is less expensive than the typically used injection molded tube. Of course, the elimination of a metal cap assembly greatly reduces the expense associated with a centrifuge tube. Further, there is no need to utilize any type of bonding which is typically associated with a large plastic cap that is sometimes placed on the open end of the centrifuge tube.

DETAILED DESCRIPTION OF THE INVENTION

Figure 1:
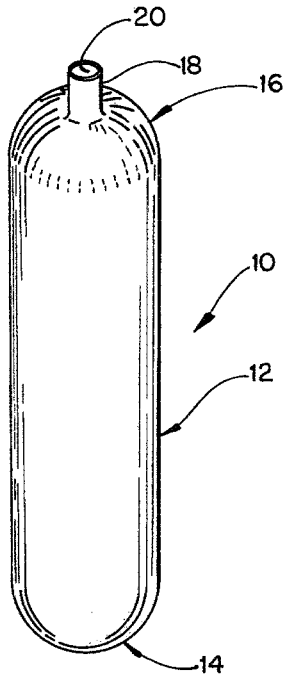
FIG. 1 is a perspective view of the preferred embodiment of the invention.

The preferred embodiment 10 of the present invention is shown in FIG. 1 having a generally cylindrical central portion 12 with a generally hemispherical bottom portion 14 and generally hemispherical top portion 16 both of which are integrally formed with the cylindrical central portion 12. Located in the top portion 16 is an integrally formed neck 18 which forms a fill port 20.

Figure 2:
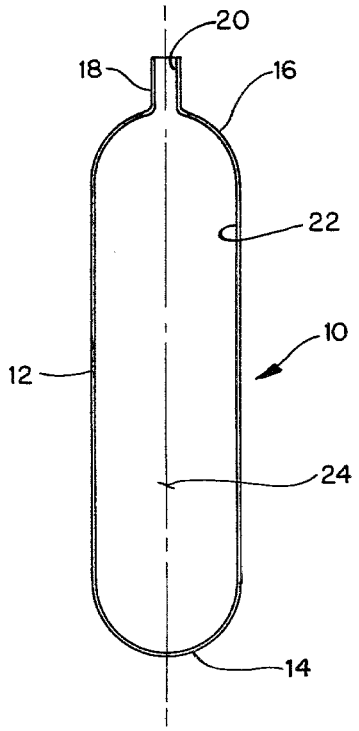
FIG. 2 is a sectional view of the present invention.
Figure 5:
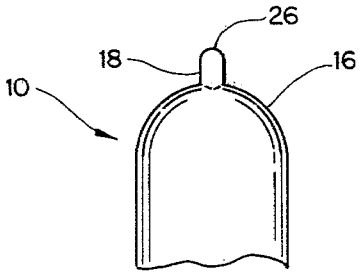
FIG. 5 is a partial side view of the preferred embodiment with fill port sealed.
Figure 12:
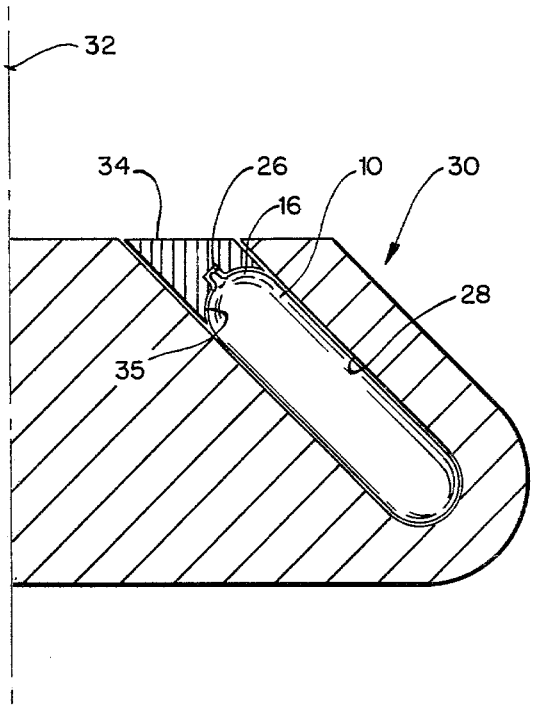
FIG. 12 is a schematic partial sectional view of a rotor having a cavity to position the centrifuge tube in an angle oblique to the spin axis.

As shown more clearly in FIG. 2, the neck portion 18 forms the fill hole or channel 20 through which the fluid sample is introduced into the interior 22 of the centrifuge tube 10. Preferably, the fill port 20 is aligned with the longitudinal center 24 of the tube 10. Once the fluid sample has been introduced into the interior 22 of the centrifuge tube 10 the neck portion 18 is fused by the application of some type of means (not shown) to create a hermetically sealed closure as shown in FIG. 5 with the formation of an integral closure 26 on the neck 18. Therefore, the centrifuge tube 10 will contain a fluid sample which is permanently and hermetically sealed within the tube 10. As shown in FIG. 12 the centrifuge tube 10 can be placed within a cavity 28 of the rotor 30 wherein the longitudinal axis of the tube 10 assumes an oblique angle orientation with respect to the spin axis 32 of the rotor. A plug or enclosure member 34 is placed over the tube to retain it within the cavity 28 during centrifugation. The plug 34 is specifically designed to have a lower surface 35 that is to mate with the upper portion 16 of the tube. The plug 34 will provide solid support to the upper portion 16 of the tube so that in conjunction with the rotor cavity 28 there will be solid support for the entire exterior surface of the tube. Although the plug 34 may be designed for threaded engagement with the top of the cavity 28, it is envisioned that the plug 34 will be designed in such a manner that its own mass in conjunction with the centrifugal forces will hold it in place to provide support to the top 16 of the tube during centrifugation.

Since the tube 10 has no removable type of capping assembly, no potential leaks will occur in the tube during centrifugation. Further, since the sealed closure 26 on the tube in FIG. 12 is inboard or closer to the spin axis 32 than the majority of the tube and its fluid contents, the permanent seal 26 will not experience significant hydrostatic forces.

Figure 13:
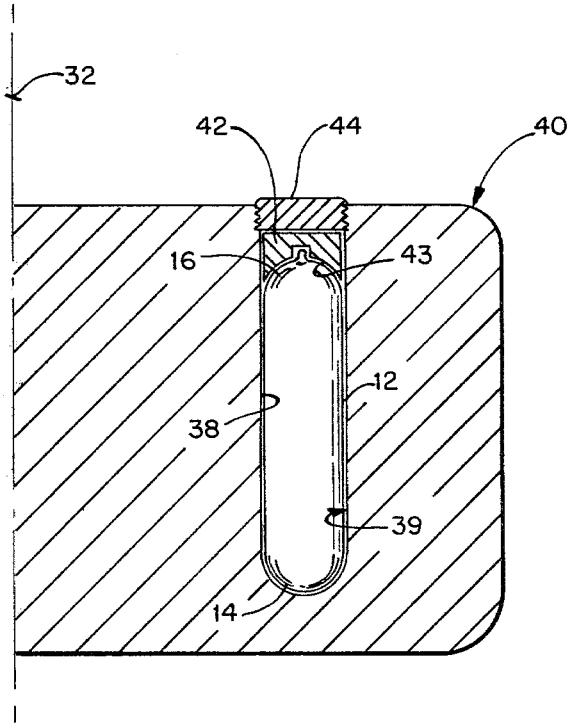
FIG. 13 is a schematic partial sectional view of the centrifuge tube of the present invention situated in a rotor where the tube is oriented at an angle zero degrees to the spin axis.

When the angle between the longitudinal axis of the tube 10 and the spin axis 32 is essentially zero as shown in the rotor 40 of FIG. 13, the hydrostatic forces exerted against the sealing closure 26 become greater. However, since the sealing portion is heat fused, the tube is a completely enclosed and hermetically sealed container with the forces being distributed equally throughout both the top portion 16 and the bottom portion 14 of the tube as well as the cylindrical side area 12. On the inboard or centripetal side 38 of the rotor cavity 39 substantially no hydrostatic forces are present. In the case of typically used centrifuge tubes having an open end with a capping assembly, acquiring a proper seal becomes very difficult because of the extreme hydrostatic forces that are exerted upon the capping assembly. In the zero angle rotor 40 in FIG. 13 some type of spacer plug 42 is placed over the upper portion 16 of the tube 10 and a threaded plug member 44 is secured into the upper portion of the cavity 39 of the rotor 40 to hold and retain the tube 10 within the cavity 39 during centrifugation. The spacer plug 42 has a lower surface 43 which is designed to conform with the upper portion 16 of the tube to provide rigid support. Therefore, the cavity 39 in the rotor 40 in conjunction with the spacer plug 42 provides solid support for the entire exterior surface of the tube. The spacer plug 42 and the threaded plug 44 can be made as one piece.

As shown in FIG. 12, the cavity 28 in the rotor 30 has a uniform shape and size from the top surface of the rotor to the bottom of the cavity. Therefore, the interior diameter of the cavity 28 is uniform from the top surface of the rotor to the bottom of the cavity. In prior high speed rotors each cavity has required an enlarged counter bore near the top surface of the rotor to accommodate the typical larger size of a capping assembly which is securely attached to the open end of presently used centrifuge tubes. However, the larger opening at the top surface of the rotor affects the allowable top speed of the rotor, since the larger opening will create a potential weakness in the rotor. When the size of the opening can be limited, the top speed of the rotor can be increased, since the rotor strength is greater due to the smaller opening.

Figure 3:
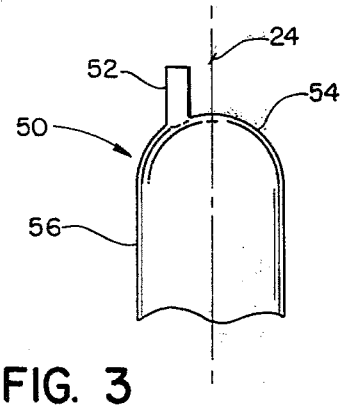
FIG. 3 is a partial side view of an alternate embodiment of the present invention.

An alternate embodiment of the present invention is shown in FIG. 3 where a test tube 50 is shown having a neck portion 52 integrally formed on the top portion 54. However, the neck portion 52 adjacent the fill port is located between the side wall 56 of the tube and the longitudinal axis 24 of the tube. Therefore, when the tube is placed within a rotor, the neck portion 52 is oriented so that it is closest to the spin axis of the rotor as possible to reduce the amount of hydrostatic head which will be exerted against the fill port area 52 which is heat sealed.

Figure 4:
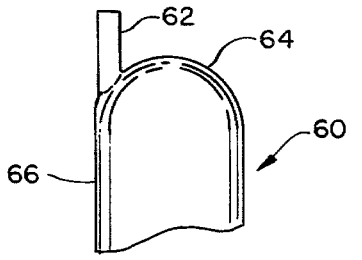
FIG. 4 is an alternate embodiment of the present invention.

A further embodiment of the present invention is shown in FIG. 4 with a centrifuge tube 60 having a neck portion 62 integrally formed on the top portion 64. The neck portion 62 is oriented closely adjacent the tube side wall 66. Therefore, when the tube 60 is placed within the rotor cavity, the neck portion 62 when the fill port is oriented in a position closest to the spin axis of the rotor on the centripetal side of the cavity, so that very little hydrostatic force is exerted against the fill port area and neck portion 62. The neck portion 62 is heat sealed to permanently enclose the entire tube 60 after the fluid sample has been placed within the tube.

Figure 6:
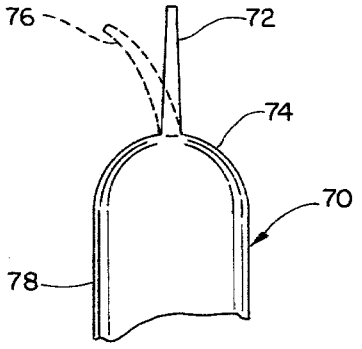
FIG. 6 is an alternate embodiment of the present invention having an elongated neck.

A further embodiment of the present invention is shown in FIG. 6 with a centrifuge tube 70 having an elongated neck portion 72 integrally formed on the top portion 74 of the tube. It should be noted that the length of the neck portion 72 which forms the fill port of the tube is greater in length than the radius or half the width of the central portion of the tube 70. Therefore, the neck portion 72 may be deflected or permanently formed to the orientation shown in phantom, so that the opening 76 in the neck portion is closer to the spin axis of the rotor than the centripetal side of the rotor cavity into which the tube is placed. Therefore, when the tube is subjected to centrifugation, the centrifugal force will prevent the escape of any fluid of the stem 72, since the opening 76 is inboard or closer to the spin axis than the side wall 78 of the tube 70.

In all the embodiments utilizing an integrally formed neck portion as shown in FIGS. 1–6 and 10 the material in the neck portion is used to form the seal when heat is applied. Therefore, no additional material or plug is required on the tube for sealing purposes.

Figure 7:
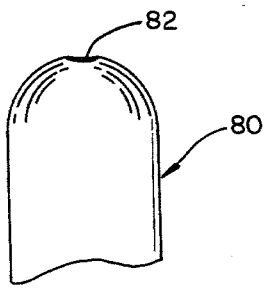
FIG. 7 is a partial side view of an alternate embodiment of the present invention having no neck adjacent the fill port.
Figure 8:
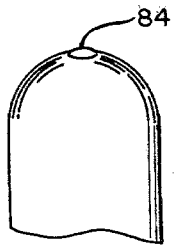
FIG. 8 is a partial side view of the alternate embodiment of the present invention as shown in FIG. 7 with a sealing closure placed in the fill port.

As shown in FIG. 7, the centrifuge tube 80 may utilize an open fill port 82 with no neck portion. Therefore, as shown in FIG. 8, a heat fusible type of material 84 must be inserted into the fill port 82 after receipt of the fluid sample within the test tube 80.

Although the important feature of the present invention is to create a centrifuge tube or container which is permanently sealed in such a manner, so that the container is completely enclosed without any removable capping assembly, the configuration of the container or tube can be greatly varied.

Figure 9:
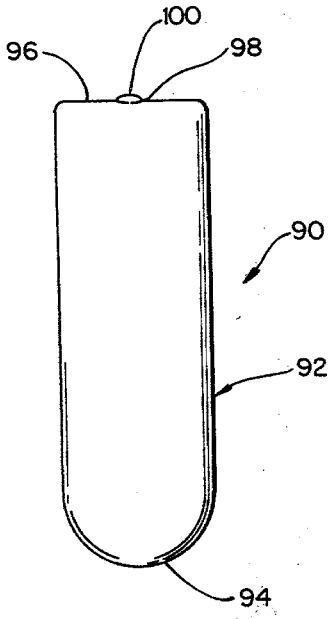
FIG. 9 is a side view of an alternate embodiment of the present invention having a flat top with a sealing closure in the fill port.
Figure 10:
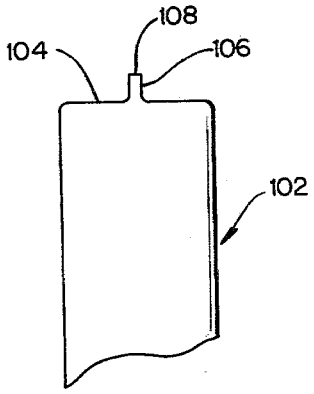
FIG. 10 is a partial side view of an alternate embodiment of the invention having a flat top with a necked portion adjacent the fill port.

In FIG. 9 a centrifuge tube 90 is shown having a general cylindrical central portion 92 with an integrally formed hemispherical bottom portion 94 and an integrally formed generally flat top portion 96 having a fill port 98 with no neck portion. A plug 100 must be fused to the fill port 98 after the introduction of fluid sample. As a further embodiment, FIG. 10 shows a centrifuge tube 102 having a flat top surface 104 with a neck portion 106 to form the fill port 108.

Figure 11:
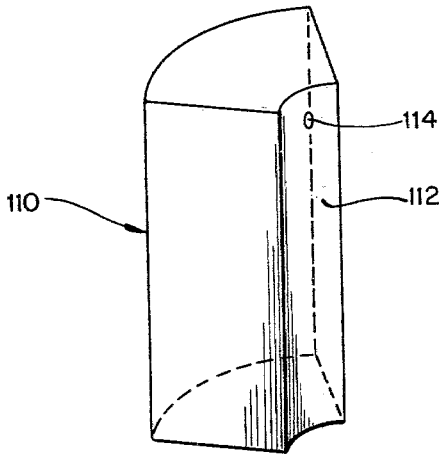
FIG. 11 is an alternate embodiment of the present invention showing a perspective view of a sector shaped container.

It is envisioned, as shown in FIG. 11, that a sector shaped container 110 could be utilized for placement in a rotor having cavities designed to receive a plurality of sector shaped containers wherein the inner surface 112 is oriented to be closest to the spin axis of the rotor. A fill port 114 is located on the inner surface 112. Since the fill port 114 is on the inboard or centripetal side of the centrifuge container during centrifugation, there will no hydrostatic forces forcing the fluid out of the fill port 114. Therefore, there is no requirement for a sealing plug as long as the fluid level, when the rotor is at rest, is not above the fill port 114.

It is envisioned that many configurations of containers or centrifuge tubes could be utilized and still encompass the true spirit and scope of the present invention. Because the present invention envisions the establishment of a container or centrifuge tube that is completely hermetically sealed after receipt of the fluid sample, no leakage from the container will occur during centrifugation. Expensive and improperly operating capping assemblies are eliminated. The only manner in which the contents within the centrifuge tube can be removed subsequent to centrifugation is by cutting the top portion or neck of the tube or puncturing the tube.

Several approaches may be used to accomplish fusion seal required on the neck portion of the various embodiments of the present centrifuge tube. One such approach would be to utilize some type of holder mechanism on which the tube is placed after receiving the fluid sample and having some type of heated element lowered into a position on the neck portion to quickly seal it and provide a hermetically sealed test tube containing the sample.

A preferable method for making the centrifuge tubes and containers as described is by extrusion blow molding. The tube can be made from a thermoplastic material preferably having a translucent or transparent characteric. One preferable type of material would be a homopolymer or copolymer such as a polyallomer wherein one of the monomers is propylene.

What is claimed is:

1. A centrifuge tube for holding a fluid sample said tube being designed in such a manner that said fluid sample is permanently sealed within said centrifuge tube without a separate tube capping assembly, said centrifuge tube comprising:

an elongated cylindrical central portion of uniform shape;

an enclosed hemispherical bottom portion integrally formed with said central portion;

an enclosed top portion integrally formed with said central portion to form in conjunction with said central portion and said bottom portion a single interior chamber within said tube with a smooth rounded surface and without sharp corners; and a neck portion integrally formed on and protruding from said top portion, said neck portion being designed to initially be open as a fill port to receive said fluid sample, said neck portion being permanently sealed after receipt of said fluid sample prior to centrifugation, said tube with said neck portion sealed to provide an integral completely enclosed and sealed centrifuge tube for placement within a centrifuge rotor, said neck portion designed to be severed after centrifugation to provide an access port to retrieve said fluid sample, said tube being made from a single integral piece of material and having prior to receipt of said fluid sample no heat seal junctions located anywhere on the tube configuration to cause possible weak areas during centrifugation, said top portion with said fill port when said fill port is permanently sealed being capable of withstanding centrifugally induced forces of said fluid sample within said tube during centrifugration.

2. A centrifuge tube as defined in claim 1, wherein said neck portion acts in response to an external sealing means to establish a permanent seal of said fill port without the use of a separately applied sealing material.

3. A centrifuge tube as defined in claim 1, wherein said neck portion is aligned with the longitudinal center of said centrifuge tube.

4. A centrifuge tube as defined in claim 1, wherein said neck portion is located adjacent the side wall of said central portion of said tube.

5. A centrifuge tube as defined in claim 1, wherein said neck portion is located between the longitudinal center of said tube and the side of said tube.

6. The centrifuge tube as defined in claim 1 wherein said neck portion is longer than half the width of said tube.

7. The centrifuge tube as defined in claim 1, wherein said top portion is hemispherical.

8. A centrifuge tube as defined in claim 1, wherein said top portion is generally flat.

9. A centrifuge tube as defined in claim 1 and additionally comprising a sealed plug placed in said fill port.

10. The centrifuge tube as defined in claim 1 and additionally comprising means for permanently sealing said fill port in such a manner that said fluid sample occupying substantially the entire interior volume of said tube will not contact any other material except the material from which said tube is made, so that said fluid sample is not contaminated.

11. A centrifuge tube as defined in claim 1 and additionally comprising means for permanently sealing said fill port in such a manner that said fluid sample will occupy substantially the entire interior volume of said tube.

12. A centrifuge tube as defined in claim 1, wherein said centrifuge tube is designed in such a manner that the complete internal volume of said single interior chamber within said tube is completely filled with said fluid sample to provide complete internal support to said tube to prevent deflection of said tube during centrifugation.

13. In a centrifuge apparatus for centrifuging a fluid sample, the combination comprising:

a centrifuge rotor having a plurality of cavities oriented at an angle less than ninety degrees with respect to the spin axis of said rotor during centrifugation;

at least one centrifuge tube containing a fluid sample mounted in one of said cavities, said tube comprising a cylindrical central portion; an enclosed hemispherical lower portion integrally formed with said central portion at one end of said central portion; an upper portion integrally formed with said central portion and enclosing the other end of said central portion, said upper portion in combination with said lower and central portions forming an enclosed chamber; and a support plug positioned within said one of said cavities above said one tube, said plug having a lower surface mating and conforming with substantially the entire outer surface of said upper portion of said tube to provide in conjunction with the interior surface of said one of said cavities complete solid support to substantially the entire exterior surface of said one tube during centrifugation so that deformation of said tube by centrifugally induced forces of said fluid sample is essentially eliminated.

14. In a centrifuge apparatus for centrifuging a fluid sample, the combination comprising:

a main rotor body having a plurality of cavities for receipt of centrifuge tubes, the longitudinal axis of said cavities oriented substantially parallel to the spin axis of the rotor;

at least one centrifuge tube within one of said cavities, said tube containing a fluid sample and being integrally formed from a single piece of material including an upper portion enclosing said tube to create a hermetically sealed interior chamber, said upper portion of said tube being exposed within said cavity;

a spacer plug positioned within said cavity over said exposed upper portion of said tube; and means secured to said rotor for holding said spacer plug tightly adjacent said upper portion of said tube to provide exterior support to said upper portion of said tube in reaction to the centrifugally induced force of said fluid sample on said upper portion of said tube.

15. In a centrifuge apparatus for centrifuging a fluid sample, the combination comprising:

a main rotor body having a plurality of cavities for receipt of sample holding centrifuge tubes, said cavities being at an acute angle to the spin axis of said rotor;

at least one centrifuge tube containing a fluid sample being located within one of said cavities, said tube being made from a single integral piece of material to form an enclosed chamber, a portion of said single integral piece of material being used to hermetically seal said tube; and a support plug positioned within said cavity over said tube, the lower surface of said plug having a mating configuration with the top of said sealed tube so that said plug will provide exterior support to the top of said tube during centrifugation, said plug resting freely on said tube and not connected to said tube, said plug being held within said cavity and securely over said tube during centrifugation by centrifugally induced forces on said plug.

* * * * *